US006120468A

United States Patent [19]

Tseng

[11] Patent Number: 6,120,468

[45] Date of Patent: Sep. 19, 2000

[54] SOUND-CONTROLLABLE MULTISTAGE MASSAGER EQUIPPED WITH LCD DEVICE

[76] Inventor: Chin-Chun Tseng, No. 13, Lane 380, Sec. 2., Chung-Shan Road, Chung-Ho City, Taiwan

[21] Appl. No.: 09/330,366

[22] Filed: Jun. 11, 1999

[51] Int. Cl.[7] ..... A61H 1/00

[52] U.S. Cl. ..... 601/46; 601/49; 601/57

[58] Field of Search ..... 601/1, 15, 18–21, 601/23, 24, 46–54, 56–58, 61, 63, 64, 89–95, 97–103, 115, 116

[56] References Cited

U.S. PATENT DOCUMENTS

| | | | |
|---|---|---|---|
| 5,020,517 | 6/1991 | Foster et al. | 601/57 |
| 5,437,608 | 8/1995 | Cutler | 601/49 |
| 5,951,500 | 9/1999 | Cutler | 601/47 |

FOREIGN PATENT DOCUMENTS

| | | | |
|---|---|---|---|
| 07289602 | 11/1995 | Japan | A61H 15/00 |

*Primary Examiner*—Glenn E. Richman

*Attorney, Agent, or Firm*—Pro-Techtor International Services

[57] ABSTRACT

A sound-controllable multistage massager equipped with LCD device comprises a massage mattress and a control device, wherein the control device comprises at least a microprocessor, a power supply device, a heating device, a sound controllable device, a motor driving device, a LCD driving device, and a key-in device. The massage mattress contains plural motors cooperative with the control device to achieve massage efficacy. A pulsating vibration is produced in this invention for hammering and kneading operation, so that a user can sit on the massage mattress for a long time massage to eliminate fatigue. A user can select desirable positions to be massaged, and adjust intensity and speed of motor vibration he sees fit. And moreover, he can also take music as an input signal via a microphone or earphone for a dual enjoyment of listening to the music when he is experiencing a pleasant massage service.

4 Claims, 13 Drawing Sheets

SOUND-CONTROLLABLE MULTISTAGE MASSAGER EQUIPPED WITH LCD DEVICE

BACKGROUND OF THE INVENTION

1. Field of the invention

This invention relates to a sound-controllable multistage massager equipped with liquid crystal display (LCD) device, particularly to a sound-controllable multi-stage massager equipped with LCD device that employs a microprocessor for controlling operation and amount of motor for people to select massage positions, and further, by means of input of music from a microphone or earphone, the massager can vibrate according to music rhythm to offer a dual enjoyment of listening to the music and experiencing relaxation by the massage.

2. Description of the Prior Art

A fair massager, including a massage chair, massage mattress, or a massage bed, is usually equipped with rollers to achieve a simple massage purpose, wherein the massage intensity and positions cannot exactly adjusted to prescribe according to the decease.

As to improve abovesaid imperfection, some massagers using programmable controller for controlling massage intensity by adjusting rotation speed of the motors have been provided to market later on. However, owing to limited functions and poor capability of delicate and considerate adjustment of massage intensity, the massager may hurt a user at his cervical vertebrae by overheavy hammering or kneading, therefore, they need some further improvements to fit individual requirements.

In view of above-described defects, after years of constant effort in research, the inventor of this invention has consequently developed and proposed this improved mechanism pertaining to the subject matter.

SUMMARY OF THE INVENTION

This invention is proposed to provide a sound-controllable multistage massager equipped with LCD device that enables a user to select massage position and intensity desired.

Another object of this invention is to provide a sound-controllable multistage massager equipped with LCD device that can show massage position on the LCD with practicability and amusement.

A next object of this invention is to provide a sound-controllable multistage massager equipped with LCD device that can help release pressure psychologically and physiologically by means of a sound-controllable input applied to a control device to realize massage vibration according to music rhythm. Hence, a user can listen to the music on the one hand and enjoy comfortableness of massage on the other.

A further object of this invention is to provide a sound-controllable multistage massager equipped with LCD device that also provides a heating device to heat and massage the same position simultaneously.

A furthermore object of this invention is to provide a sound-controllable multistage massager equipped with LCD device that can provide pulsating massage.

A sound-controllable multistage massager equipped with LCD device of this invention possessed abovesaid merits is mainly composed of a massage mattress and a control device. The massage mattress contains plural motors that vibrate to achieve massage purpose. The control device comprises at least a microprocessor, a sound-controlled device, a LCD driver, a motor driving circuit, a key-in device, a heating device and a power supply, wherein the power supply provides DC power for all the devices; the microprocessor is pre-set with various massage functions for selection. The microprocessor applies pulse signals to the motor driving circuit to drive and control the motor amount. The heating device provides a heating function in addition to normal massage function. The program may switch the heating function to a sound-controllable function, so that a user can enjoy listening to the music and experiencing comfortableness from massage.

BRIEF DESCRIPTION OF THE DRAWINGS

For a better understanding to the present invention, together with further advantages or features thereof, at least one preferred embodiment will be elucidated below with reference to the annexed drawings in which.

DETAILED DESCRIPTION OF THE PREFERRED EMBODIMENT

Figure 1:
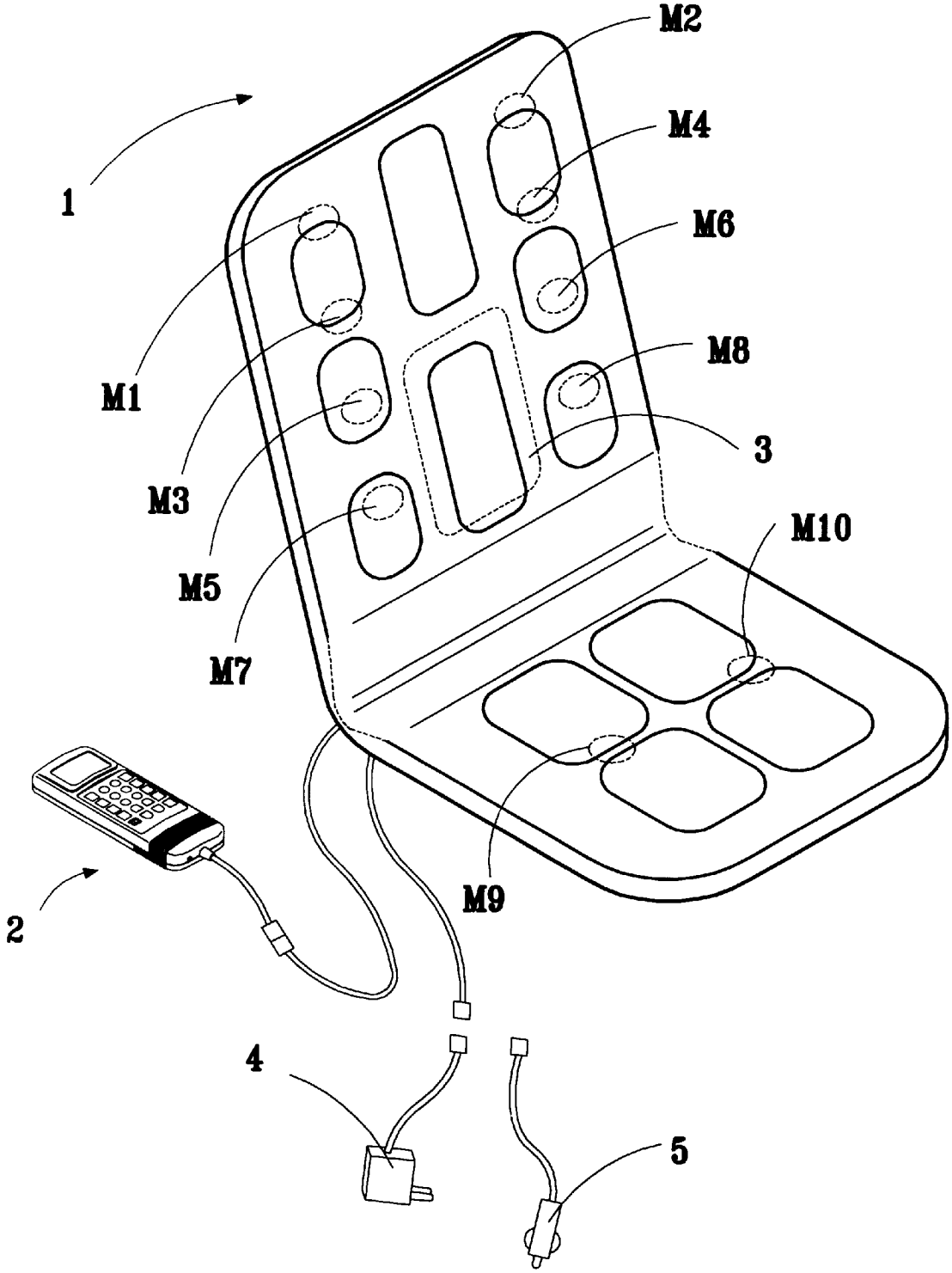
FIG. 1 is a schematic embodiment diagram of a sound-controllable multistage massager equipped with LCD device of this invention.
Figure 2:
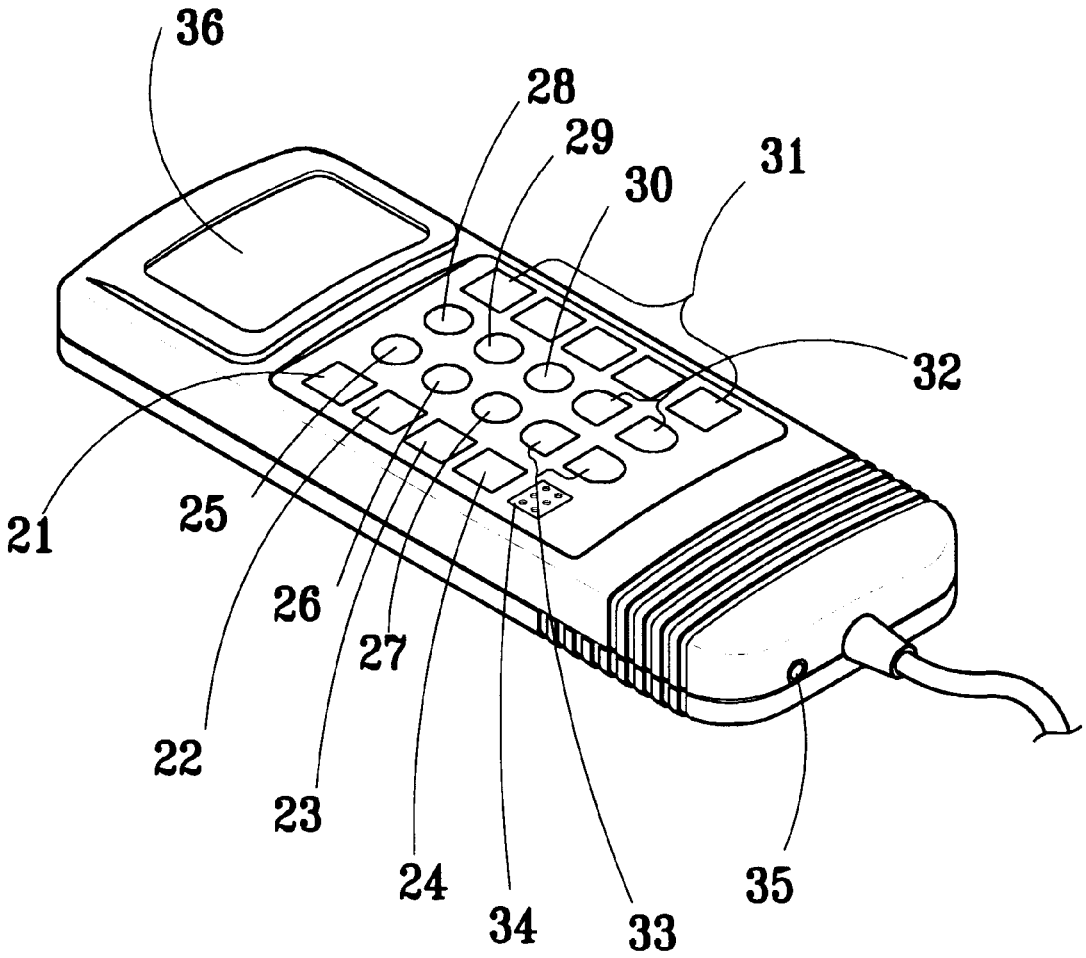
FIG. 2 is a schematic view of control panel of the sound-controllable multistage massager equipped with LCD device of this invention.
Figure 3:
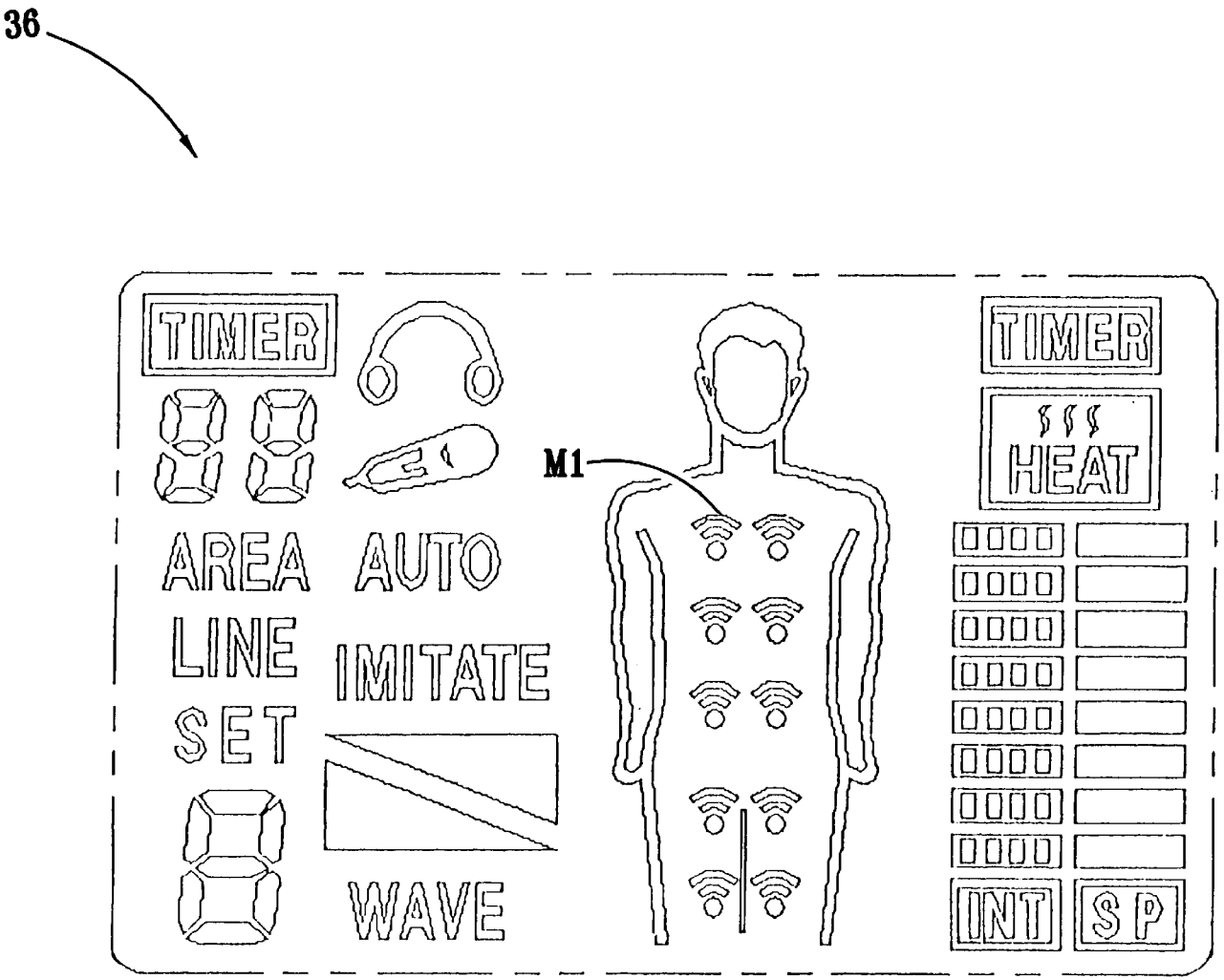
FIG. 3 is a schematic view of display screen of the sound-controllable multistage massager equipped with LCD device of this invention.

As shown in FIG. 1 through FIG. 3, a sound-controllable multi-stage massager with LCD (liquid crystal display) device of this invention is composed of a control device and a massage mattress 1, wherein the control device further comprises a microprocessor, a sound-controllable device, a LCD driver and a motor driving circuit, etc; a control panel 2 is disposed on a front face of the control device; the massage mattress 1 is provided with an electric heater 3 and 10 pieces of massage motor M1~M10; and by means of a power rectifier or designated receptacle 5 in an automobile, DC power can be applied to the control device for driving the massage motors.

A user is supposed to select and key in one of function keys disposed on the control panel 2, including:

(1) Power key 21, which is used to control power ON/OFF of the massager.

(2) Time pre-set key 22, which is used to control time of massage and heating that will be shown on a LCD screen 36.

(3) Heating function key 24, which is used to switch close/open of the electric heater 3 that will be shown on the LCD screen 36.

(4) Local area setting function key 28, which provides 5 massage modes with 5 functions selectable in each mode via a group of selection keys 31. A user can select a local or whole area massage as desired, and in each massage mode, intensity and speed can be adjusted and shown on the LCD screen 36. Those 5 massage modes include:

mode 1—a reciprocal wave type;

mode 2—a zigzag type;

mode 3—a left half and right half part of a human body interchangeable vertical type;

mode 4—an upper half and lower half (above or below waist line) interchangeable type;

mode 5—selection of local area or whole body.

(5) Whole area setting function key 29, which comprises 5 massage modes for selection, and by means of a built-in massage program, provides an omnidirectional massage plan for an utmost relaxation. Those 5 massage modes include:

mode 1—a wave massage manner from top to bottom in order of motor driving: M1+M2+M3+M4→M3+M4+M5+M6→M5+M6+M7+M8→M7+M8+M9+M10→. . . ;

mode 2—a combined up-and-down massage manner, from top to bottom and left to right and vice versa for a whole body massage in order of motor driving: M1+M3→M5→M7+M9→M2+M4→M6→M8+M10→. . . ;

mode 3—a double X type from top to bottom massage manner in order of motor driving: M1→M4→M3→M5→M6→M7→M10→M8→M9→. . . ;

mode 4—a S type up-and-down reciprocal massage manner in order of motor driving: M1+M3→M4+M6→M7+M9→M8+M10→M5+M7→M2+M4→M1+M3 . . . ;

mode 5—a pulse type massage manner moving for next position after 3-time massage in order of motor driving: M1+M2 (3 times)→M3+M4 (3 times)→M5+M6 (3 times)→M7+M8 (3 times)→M9+M10 (3 times).

(6) Mono-function setting key 30, which is a designated point massage manner providing 4 massage modes, and each mode may have 5 functions via selection keys 205 for a user to select massage position, intensity, and speed which will be shown on the LCD screen 36. Abovesaid 4 modes include:

mode 1—a hammering type massage with massage positions selectable in order of motor driving: M1→M2→M1→M2→. . . or M3→M4→M3→. . . or . . . →M9→M10→M9→M10→;

mode 2—a reciprocal hammering type massage with positions selectable in order of motor driving: M1→M2, M2→M1, M1→M2 . . . or M3→M4, M4→M3 . . . or M9→M10, M10→M9;

mode 3—a pulse type massage with positions selectable by hand in order of motor driving: M1+M2, or M3+M4, or M5+M6, or . . . , or M9+M10 . . . ;

mode 4—a continuous type massage with positions selectable by hand in order of motor driving: M1+M2, or M3+M4, or M5+M6, or . . . or M9+M10.

(7) Speed function key 32, which is used to adjust vibration speed of the motors, and the adjusted speed will be shown on the LCD screen 36.

(8) Intensity function key 33, which is used to adjust massage intensity, and data will be shown on the LCD screen 36.

(9) Waving function key 26, which is used to cooperate with the local area setting, whole area setting, and mono-function setting for intensity variation, from the strong to the weak and vice versa to provide a kneading efficacy.

(10) Simulating function key 27, which is used to simulate music for motor vibration and is cooperative to local area setting, whole area setting, and mono-function setting for different massage efficacies.

(11) Automatic setting function key 25, which is used to present all the functions one after another in order of motor driving shown in table 1.

(12) Microphone function key 23, which is used for music input to the control device from an earphone receptacle 35 or a microphone 34 to enable intensity and speed of massage to change following variation of audio frequency, so that a user can enjoy music and massage simultaneously for recovery from fatigue.

The LCD screen 36 facilitates easy operation of the massager that a user can select different favorite ways of massage for relaxation.

Figure 4:
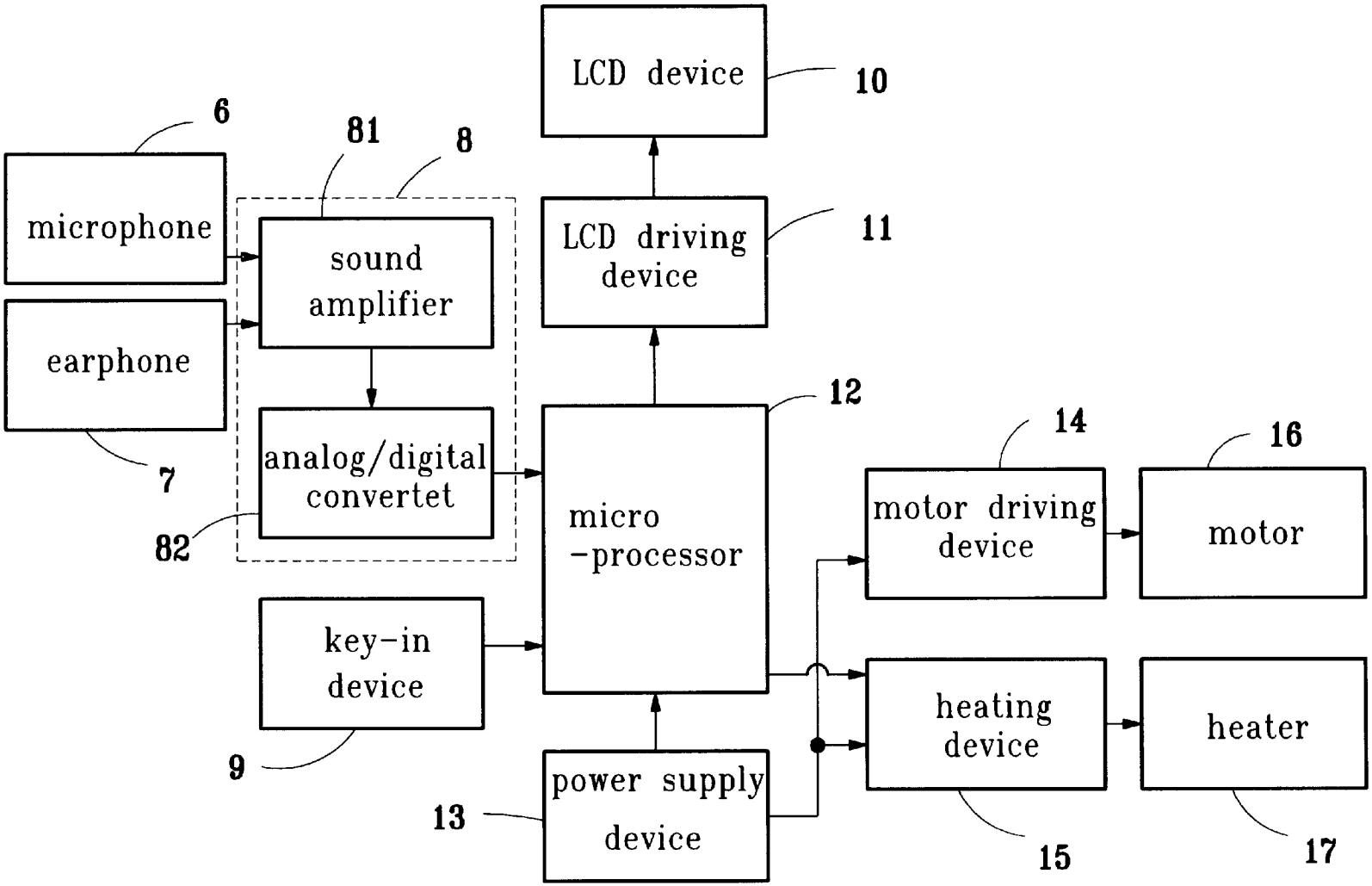
FIG. 4 is a block diagram of the sound-controllable multistage massager equipped with LCD device of this invention.
Figure 5A:
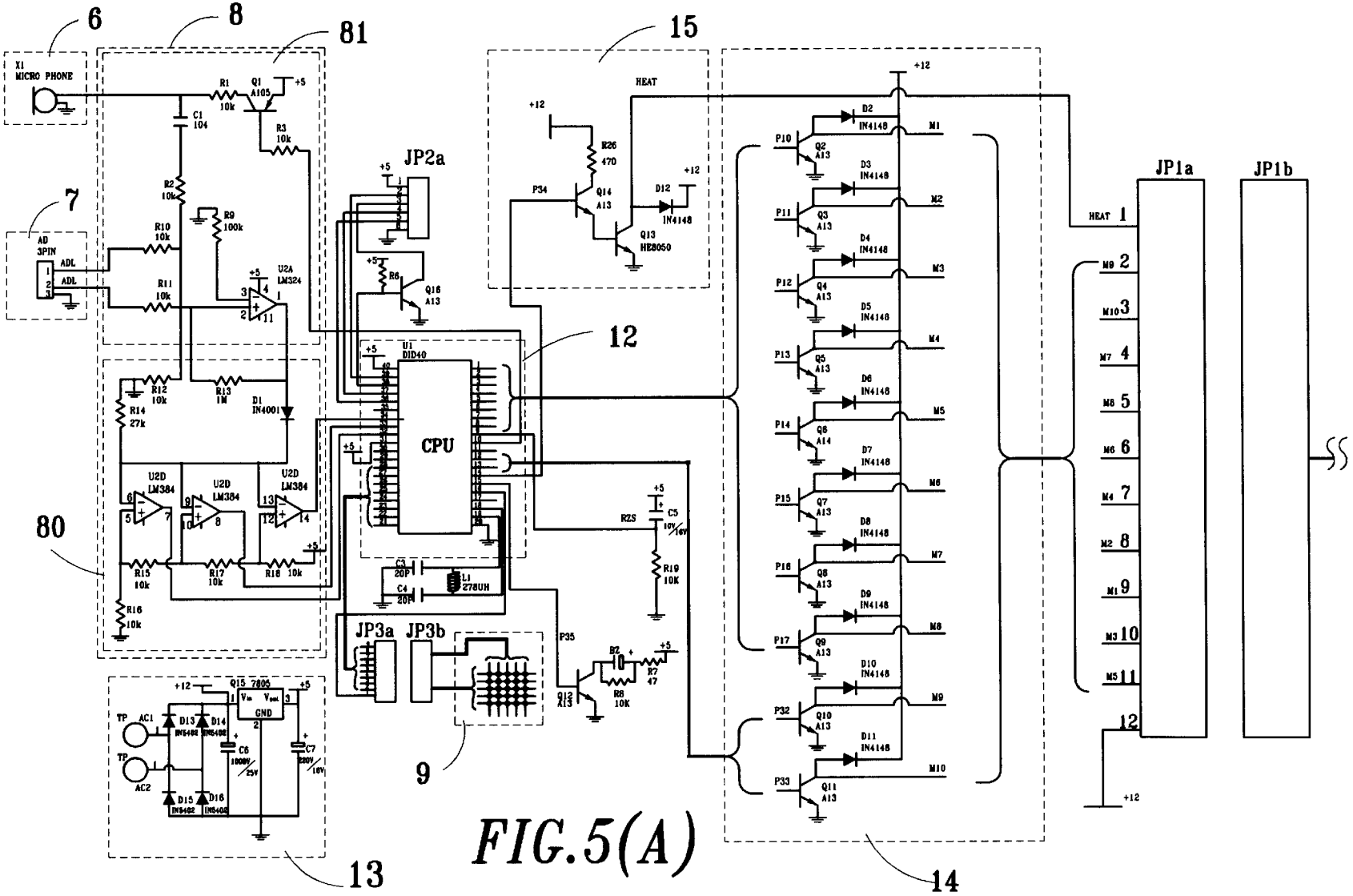
FIGS. 5A and 5B show electric circuits of the sound-controllable multistage massager equipped with LCD device of this invention.
Figure 5:
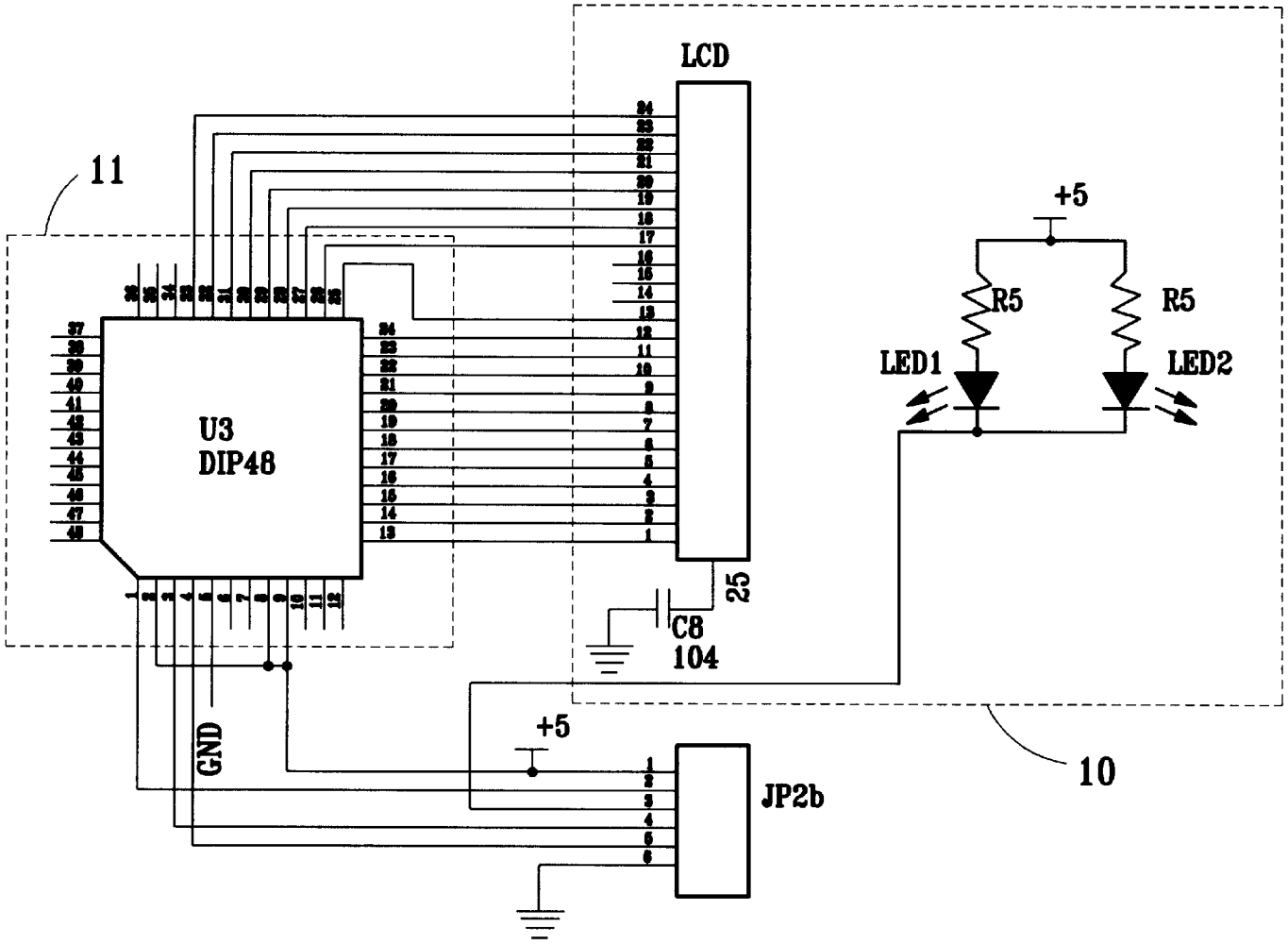

According to FIGS. 4 and 5—a block and circuit diagram of a sound-controllable multi-stage massager with LCD device, this invention comprises a microprocessor 12, a sound-controllable device 8, a key-in device 9, a power supply 13, a LCD driver 11, a motor driving circuit 14, and a heating device 15. The microprocessor 12 is used to judge and process an input signal, and provide an output signal to a relative output device. The sound-controllable device 8 is composed of an audio signal amplifier 81 and an analog/digital converter 82, wherein an input signal from a microphone 6 or an earphone 7 is amplified by the amplifier 81, and then converted from analog into digital by the converter 82 before applying to an input terminal of the microprocessor 12. The key-in device 9 is used to supply a selected function, and the power supply 13 supplies DC power as commonly known. The LCD driver 11 is used to display output signal data of the microprocessor 12 on the LCD device 10. The motor driving circuit 14 is used to drive and control amount of motor 16, while the heating device 15 controls action of a heater 17.

Figure 6:
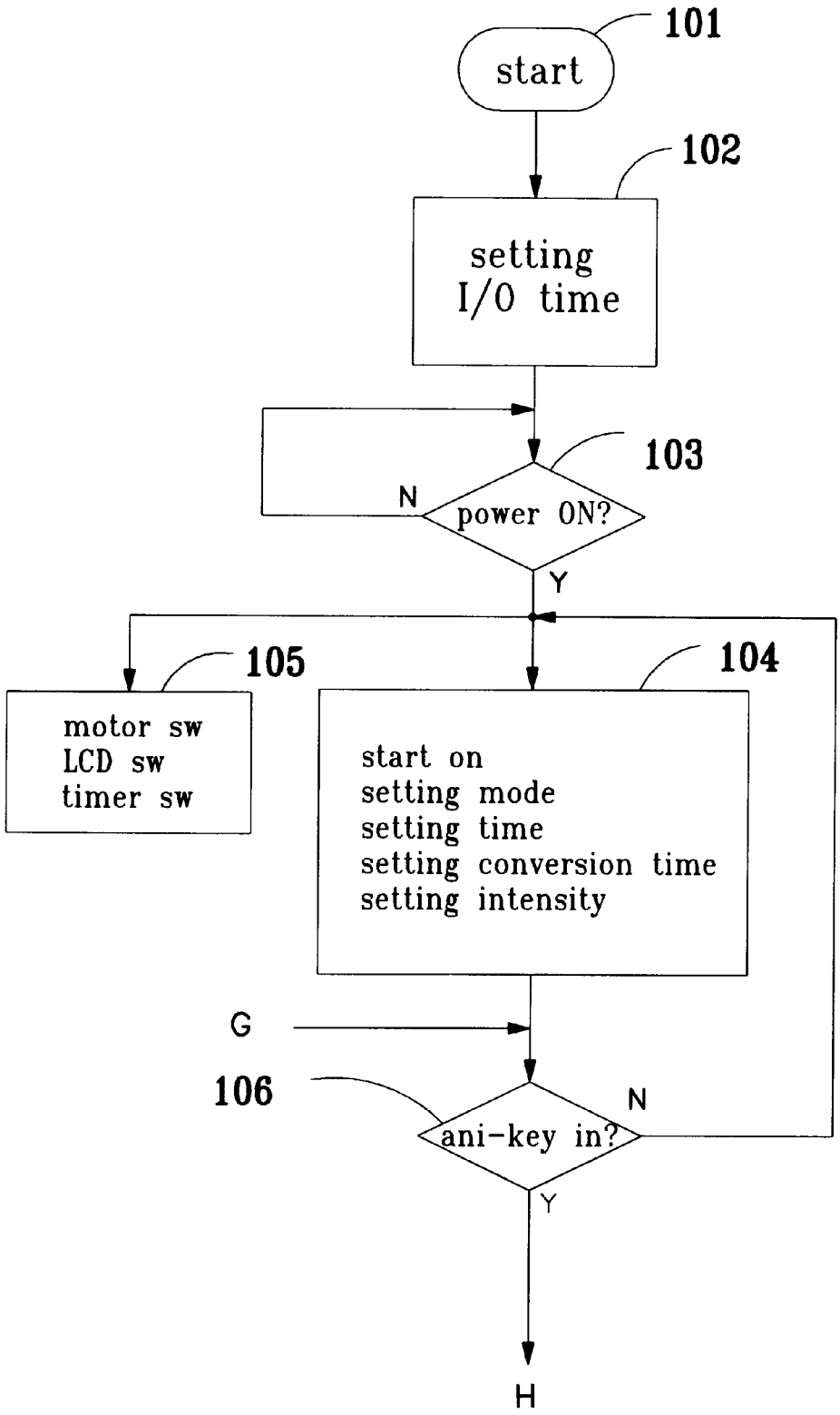
FIGS. 6A and 6B show a main flow chart of the sound-controllable multistage massager equipped with LCD device of this invention.
Figure 6:
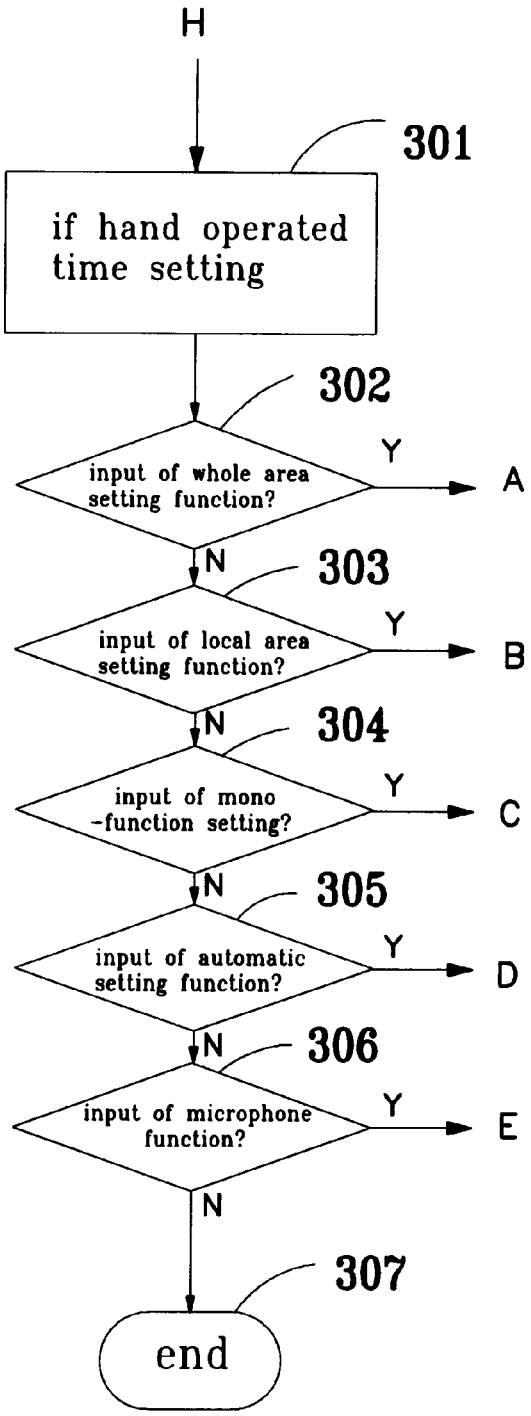

FIGS. 6A and 6B show a main flow chart of the sound-controllable multi-stage massager with LCD device of this invention. The main program is executed as the following:

Starts 101 to initialize I/O, time, and LCD 102.

Judges if the power switch is closed?

If negative, the massager is under "OFF" state; otherwise, the massager acts according to pre-set mode, time, speed and intensity of motor 104, and control switch of the motors, LCD, and timer 105.

Judges if any input of key-in available 106?

If negative, the massager acts according to pre-set manner; otherwise, the program resets time 301.

Judges if the whole area function key is pressed 302?

Figure 7:
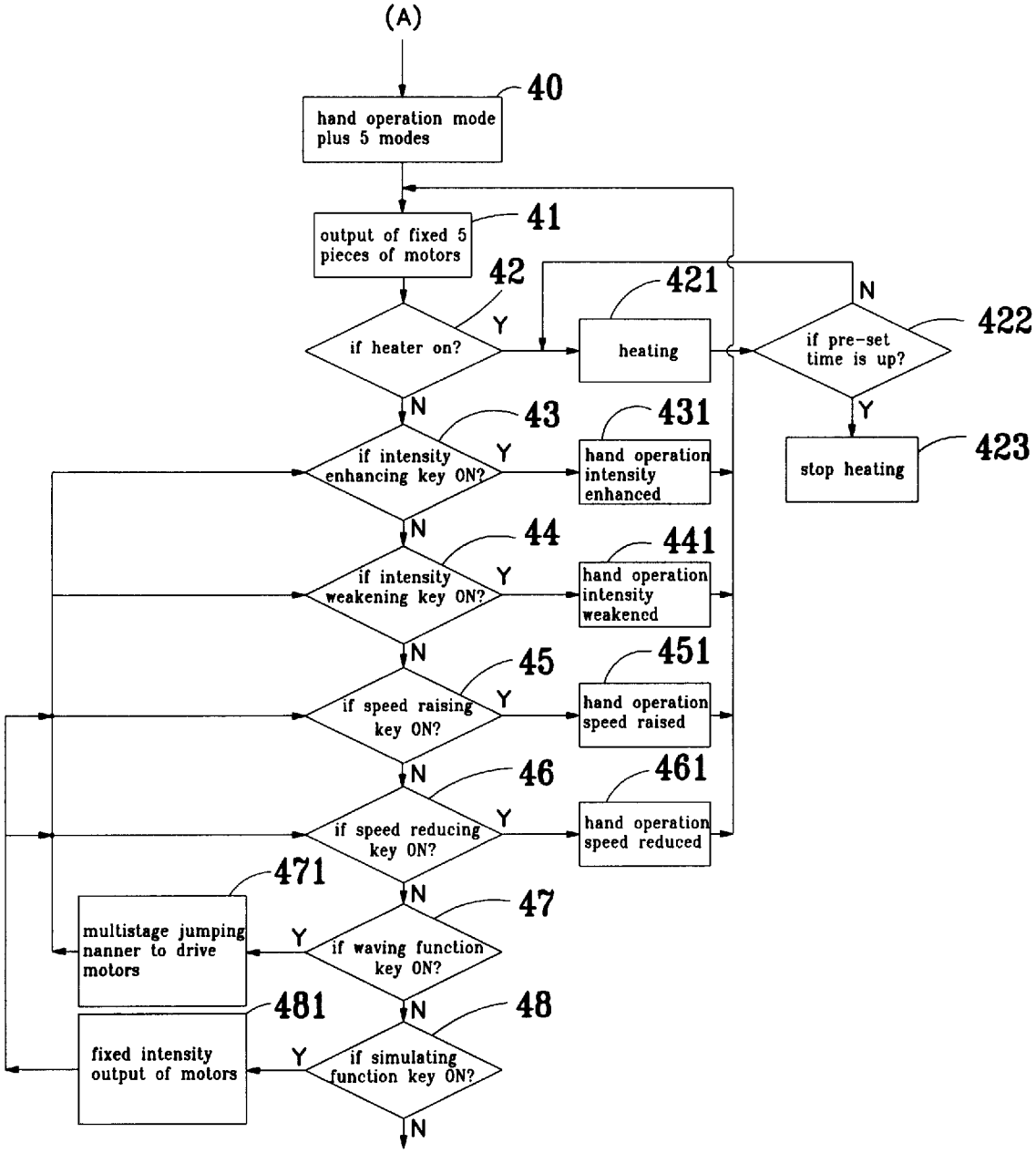
FIG. 7 through FIG. 11 show subroutine A~E of the sound-controllable multistage massager equipped with LCD device of this invention.

If positive, the program jumps to a subroutine A (as shown in FIG. 7); otherwise, judges if the local area function key is pressed 303?

Figure 8:
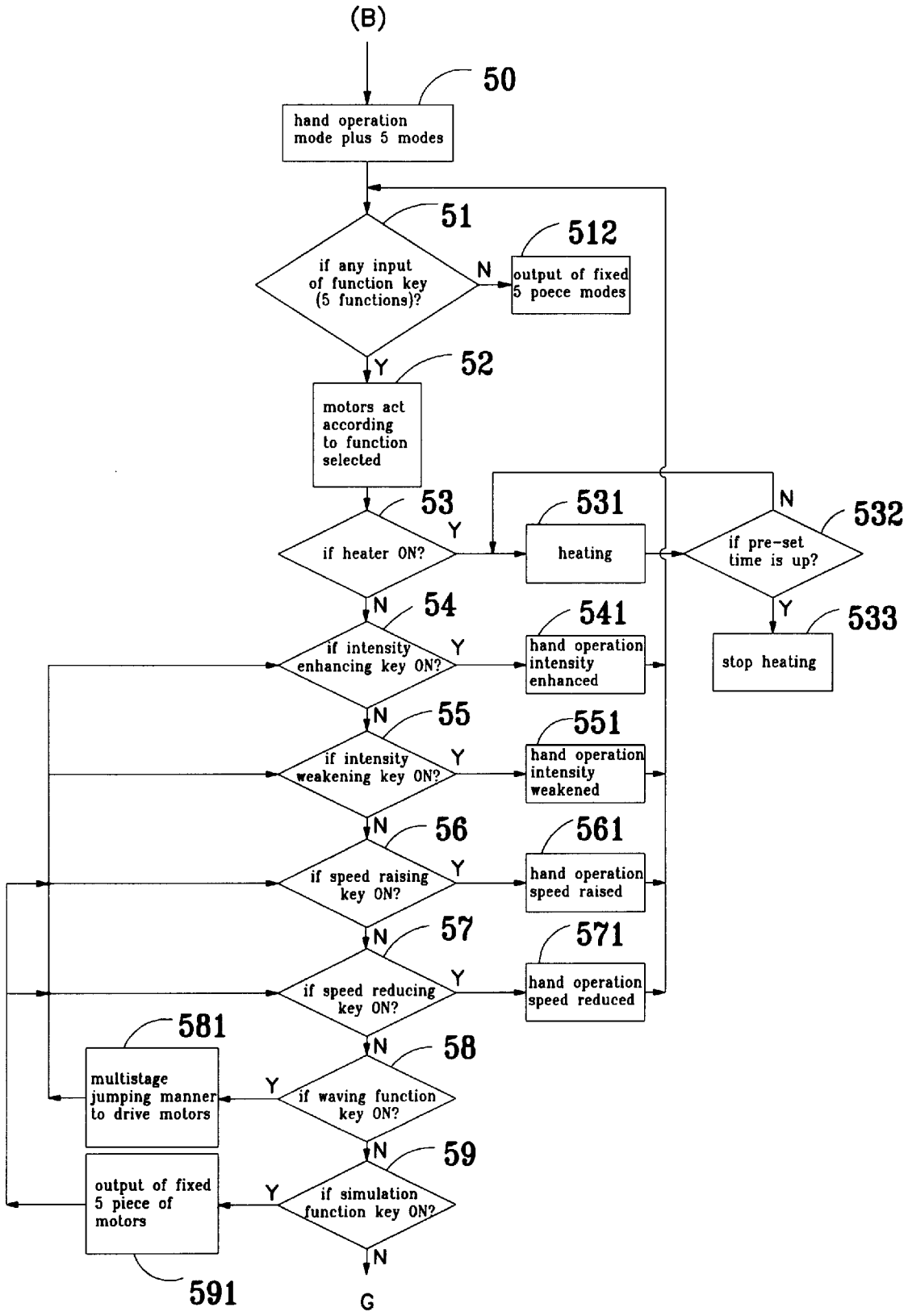

If positive, the program jumps to a subroutine B (as shown in FIG. 8); otherwise, judges if the mono-function key is pressed 304?

Figure 9:
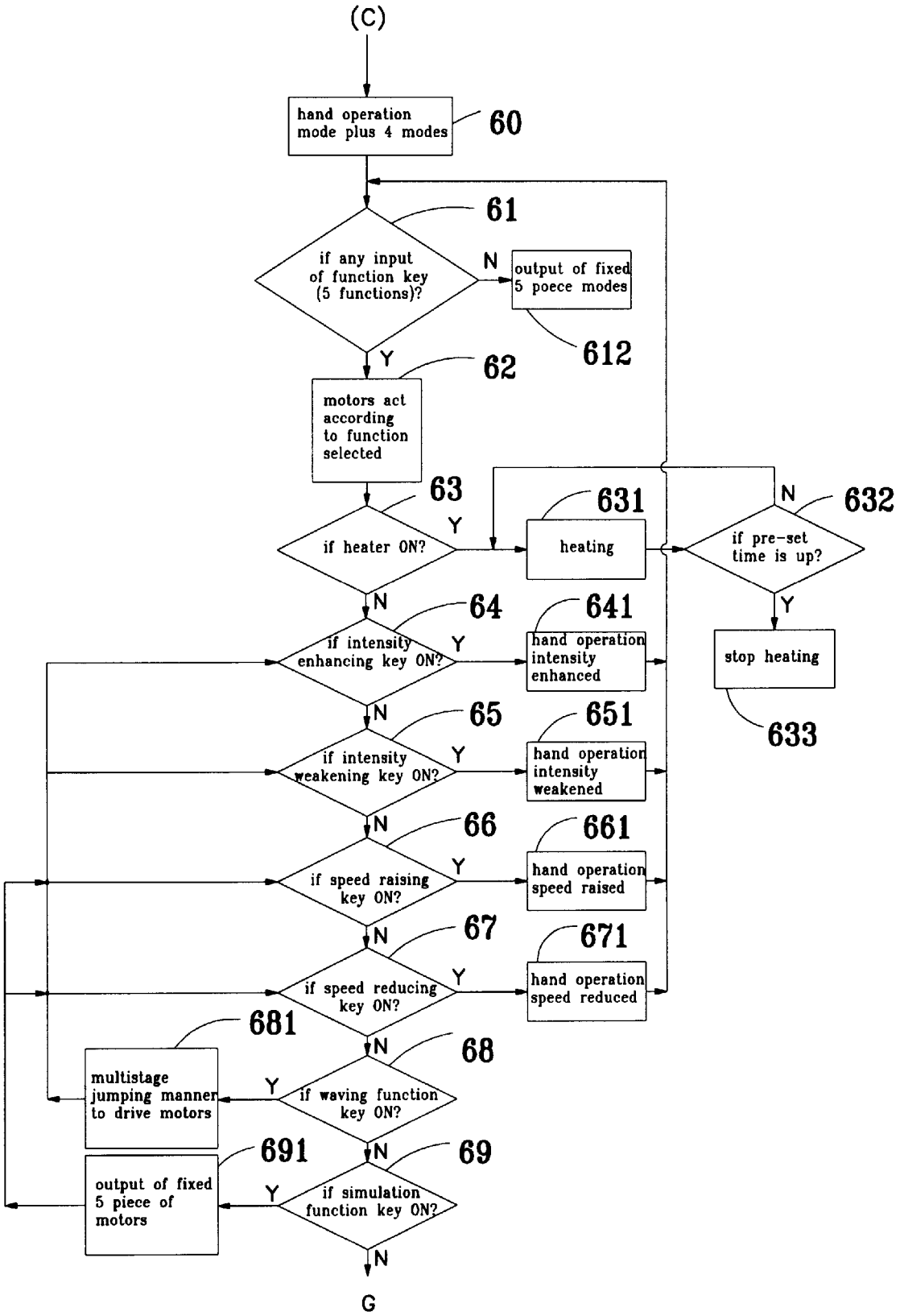

If positive, the program jumps to a subroutine C (as shown in FIG. 9); otherwise, judges if the automatic setting key is pressed 305?

Figure 10:
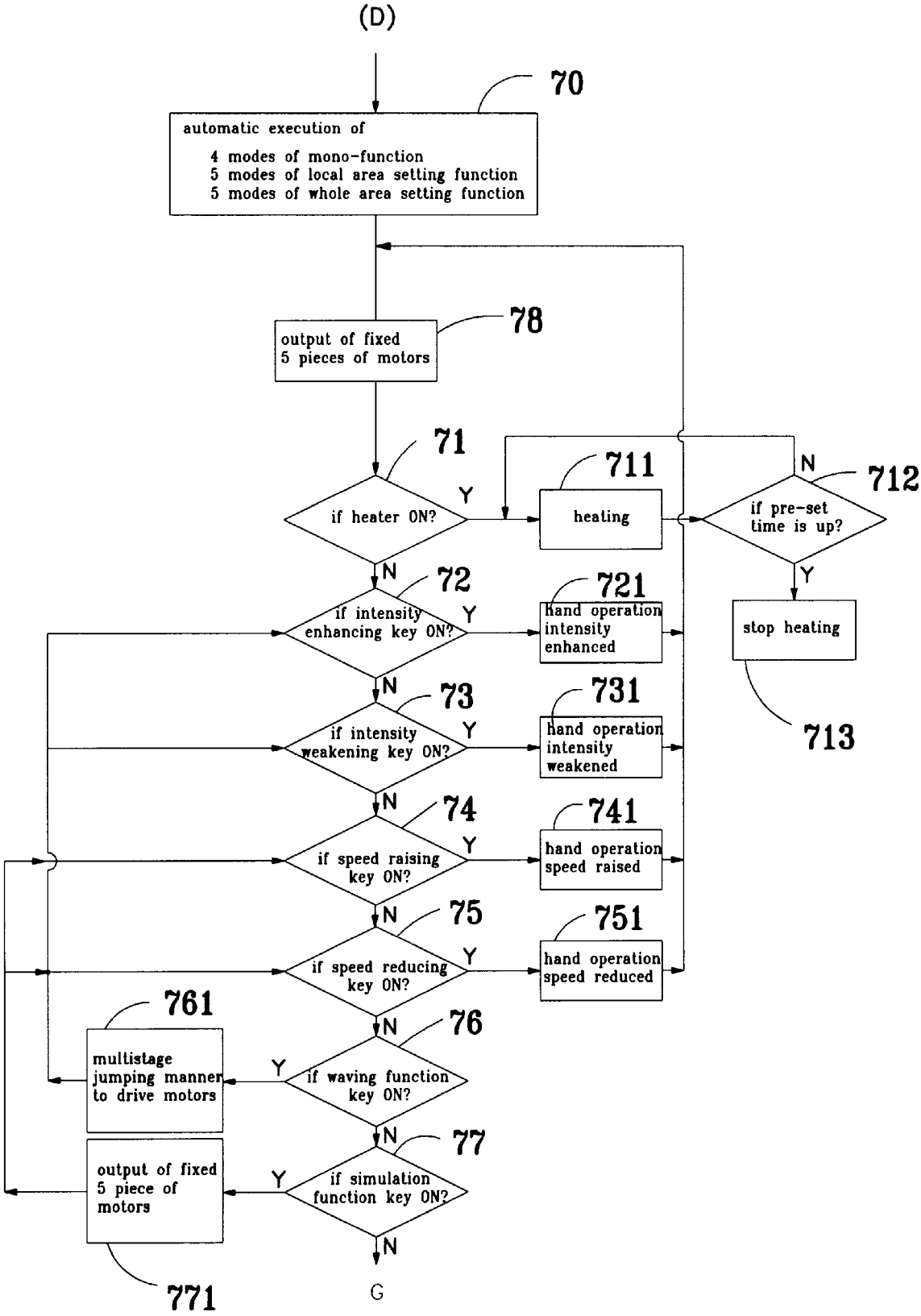
Figure 11:
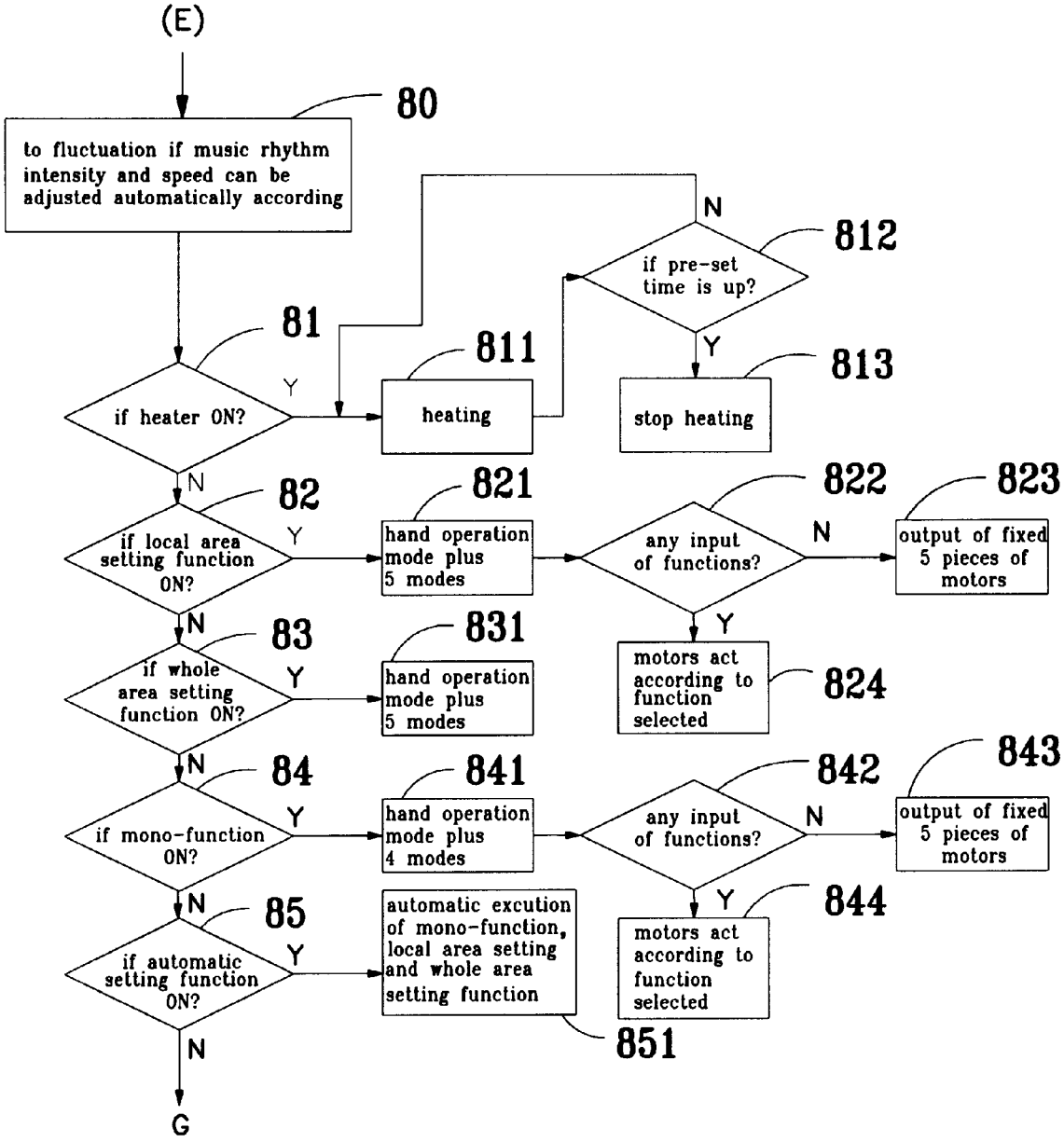

If positive, the program jumps to a subroutine D (as shown in FIG. 10); otherwise, judges if the microphone function key is pressed 306? If positive, the program jumps to a subroutine E (as shown in FIG. 11); otherwise, closes the flow chart 307.

FIG. 7 indicates the subroutine A of this invention, which means the whole area function key is pressed. The subroutine A including 5 modes of massage manner 40 is executed as the following:

The motors are driven 41 according to one desired massage mode selected by a user 40, and the subroutine A judges if the heater is enabled 42? If positive, the heater starts heating 421, and the subroutine A judges if time is up 422? If positive, the heater stops heating 423; otherwise, the heater keeps heating.

If the heater is disabled, the subroutine A judges if an intensity enhancing function key is pressed 43?

If positive, massage intensity is enhanced 431 and so is the vibration intensity of the motors 41; otherwise, the subroutine A judges if an intensity weakening key is pressed 44?

If positive, the intensity is weakened 441 and so is the vibration intensity of the motors 41; otherwise, the subroutine A judges if a speed raising function key is pressed 45?

If positive, speed is raised 451 and so is the vibration speed of the motors 41; otherwise, the subroutine A judges if a speed reducing function key is pressed 46?

If positive, speed is reduced 461 and so is the vibration speed of the motors 41; otherwise, the subroutine A judges if the waving function key is pressed 47?

If positive, the massage intensity will convert from the weak to the strong and vice versa cyclically and automatically 471, and where the speed reducing function key 46, the speed raising function key 45, the intensity weakening key 44, and the intensity enhancing key 43 are all pressable; otherwise, the subroutine A judges if the simulating f unction key is pressed 48?

If positive, the vibration intensity of the motors cannot be adjusted 481, only the speed raising f unction key 45 and the speed reducing function key 46 can be pressed; otherwise, the subroutine A returns to G.

FIG. 8 indicates the subroutine B of this invention. When local area function is selected, the subroutine B comprises 5 massage modes 50, wherein each massage mode further comprises 5 functions for selection. The subroutine B is executed as the following:

The subroutine B judges if any function is selected 51?

If negative, the motors act according to pre-set driving mode 512; otherwise, the motors act according to selected function 52, then judges if the heater is enabled 53?

If positive, the heater starts heating 531, and the subroutine B judges if the pre-set heating time is up 532? If positive, the heater stops heating 533; otherwise, the heater keeps heating 531.

If the heater is disabled, the subroutine B judges if any input from the intensity enhancing function key is available 54?

If positive, intensity is enhanced 541 and so is the vibration intensity of the motors 51; otherwise, the subroutine B judges if the intensity weakening function key is pressed 55?

If positive, the intensity is weakened 551, and so is the vibration intensity of the motors 51; otherwise, the subroutine B judges if the speed raising function key is pressed 56?

If positive, the speed is raised up 561 and so is the vibration speed of the motors 51; otherwise, the subroutine B judges if the speed reducing function key is pressed 57?

If positive, the speed is reduced 571 and so is the vibration speed of the motors 51; otherwise, the subroutine B judges if the waving function key is pressed 58?

If positive, the massage intensity varies from the weak to the strong and vice versa cyclically and automatically 581, and where the speed reducing function key 57, the speed raising function key 56, the intensity weakening function key 55, and the intensity enhancing function key 54 are pressable; otherwise, the subroutine B judges if the simulating function key is pressed 59?

If positive, the vibration intensity of the motors is unadjustable 591, only the speed raising function key 56 and the speed reducing function key 57 can be pressed; otherwise, the subroutine B returns to G.

FIG. 9 indicates the subroutine C of this invention. When the mono-function setting is selected, the subroutine C comprises 4 massage modes 60, wherein each mode further comprises 5 functions for selection. The subroutine C is executed as the following:

The subroutine C judges if any function input is available 61?

If negative, the motors are driven according to pre-set mode 611; if positive, the motors are driven according to a selected function 62, then judges if the heater is enabled 63?

If positive, the heater starts heating 631, and the subroutine C judges if pre-set heating time is up 632? If positive, the heater stops heating 633; otherwise, the heater keeps heating 631.

If the heater is disabled, the subroutine C judges if the intensity enhancing function key is pressed 64?

If positive, the intensity is enhanced 641 and so is the vibration intensity of the motors 61; otherwise, the subroutine C judges if the intensity weakening function key is pressed 65?

If positive, the intensity is weakened 651 and so is the vibration intensity of the motors 61; otherwise, the subroutine C judges if the speed raising function key is pressed 66?

If positive, the speed is raised up 661 and so is the vibration speed of the motors 61; otherwise, the subroutine C judges if the speed reducing function key is pressed 67?

If positive, the speed is reduced 671 and so is the vibration speed of the motors 61; otherwise, the subroutine C judges if the waving function key is pressed 68?

If positive, the massage intensity can be varied from the weak to the strong and vice versa cyclically and automatically 681, and where the speed reducing function key 67, the speed raising function key 66, the intensity weakening function key 65, and the intensity enhancing function key 64 are all pressable; otherwise, the subroutine C judges if the simulating function key is pressed 69?

If positive, the vibration intensity of the motors is unadjustable 691, and only the speed raising function key 66 and the speed reducing function key 67 are pressable; otherwise, the subroutine C returns to G.

FIG. 10 indicates the subroutine D of this invention. When the automatic setting function is selected, the subroutine D comprises 4 massage modes of the mono-function setting function, 5 massage modes of the local area setting function, and 5 massage modes of the whole area setting function which are executed automatically 70 to enable the motors to provide designated outputs 78. The subroutine D is executed as the following:

The subroutine D judges if the heater is enabled 71?

If positive, the heater starts heating 711, then the subroutine D judges if heating time is up 712? If positive, the heater stops heating 713; otherwise, the heater keeps heating 711.

If the heater is disabled, the subroutine D judges if the intensity enhancing function key is pressed 72?

If positive, the intensity is enhanced 721 and so is the vibration intensity of the motors 78; otherwise, the subroutine D judges if the intensity weakening function key is pressed 73?

If positive, the intensity is weakened 731 and so is the vibration intensity of the motors 78; otherwise, the subroutine D judges if the speed raising function key is pressed 74?

If positive, the speed is raised up and so is the vibration speed of the motors 78; otherwise, the subroutine D judges if the speed reducing function key is pressed 75?

If positive, the speed is reduced and so is the vibration speed of the motors 78; otherwise, the subroutine D judges if the waving function key is pressed 76?

If positive, the massage intensity can be varied from the weak to the strong and vice versa cyclically and automatically 761, and where the speed reducing function key 75, the speed raising function key 74, the intensity weakening function key 73, and the intensity enhancing function key 72 are all pressable; otherwise, the subroutine D judges if the simulating function key is pressed 77?

If positive, the vibration intensity of the motors is unadjustable 771, only the speed raising function key 74 and the speed reducing function key 75 can be pressed; otherwise, the subroutine D returns to G.

FIG. 11 indicates the subroutine E of this invention. When the microphone function is selected, the vibration intensity and speed can be adjusted automatically 80 according to fluctuation of music rhythm. The subroutine E is executed as the following:

The subroutine E judges if the heater is enabled 81?

If positive, the heater starts heating 811, then the subroutine E judges if the pre-set heating time is up 812? If positive, the heater stops heating 813; otherwise, the heater keeps heating 811.

If the heater is disabled, the subroutine E judges if the local area setting function key is pressed 82?

If positive, a desired massage mode may be selected 821, and the subroutine E will judge if any function input is available 822? If negative, the motors will vibrate according to a pre-set mode; otherwise, according to the function selected 824.

If no local area setting function is selected, the subroutine E will judge if the whole area setting function is selected 83?

If positive, a desired massage mode may be selected 831; otherwise, the subroutine E judges if the mono-function key is pressed 84?

If positive, a user may select a desirable massage mode 841, and the subroutine E will judge if a function key is pressed 842?

If negative, the motors will operate according to a pre-set mode 843; if positive, the motors will operate according to the selected function 844.

If the mono-function key has not been pressed, the subroutine E then judges if the automatic setting function key is pressed 85?

If positive, the subroutine E will execute those 5 massage modes of the local setting function, 5 massage modes of the whole area setting function, and 4 massage modes of the mono-function automatically 851; otherwise, the subroutine E returns to G.

From the abovesaid, the advantages of this invention may be summarized as below:

1. A microprocessor is used to provide more massage functions than a usual massager, a user can select position(s) desired for fatigue elimination.

2. Pulse vibration of this invention enables the motors to operate or stop instantaneously that provides a hammering and kneading efficacy.

3. An audio frequency, music for example, may be applied to the massager via a microphone or earphone for controlling vibration of the motors, that is, the higher music frequency the higher vibration intensity of the motors, so that a user can enjoy a dual efficacy of listening to the music and getting refreshed by the massage simultaneously.

4. The vibration intensity of the motors is adjustable to an extent as down as the human cervical vertebrae can suffer to thereby assure a user's security.

Although, this invention has been described in terms of preferred embodiments, it is apparent that numerous variations and modifications may be made without departing from the true spirit and scope thereof, as set forth in the following claims.

What is claimed is:

1. A sound-controllable multistage massager equipped with an LCD device comprising:

a massage mattress and a control device, said massage mattress comprises a plurality of motors and a heater, said massage mattress is divided into a plurality of independent sections, and said control device further comprises at least a microprocessor to process an input function from a key-in device and provide an output signal to a related output device;

an LCD driving device which is used to drive said LCD device to display output signals of said microprocessor;

a heating device;

a sound-controllable device comprising a sound amplifier and an analog/digital converter, wherein said sound amplifier is used to amplify an input sound; and said analog/digital converter is used to convert said input sound into digital signals to be processed by said microprocessor;

a power supply device to provide DC power to said control device;

a motor driving circuit to drive said motors and to control a varying amount of power output from said motors according to output signals from said microprocessor, each of said motors supplying a massage motion to one of said independent sections of said massage mattress at a power level chosen by a user of said massager;

a key-in device which is used to input a selected function; such that when an input signal from said key-in device or said sound-controllable device is received by said microprocessor, said microprocessor processes said input signal and transmits an output signal to said motor driving circuit, and said output signal is displayed on a screen of said LCD device.

2. The sound-controllable multistage massager equipped with LCD device of claim 1, wherein said massage mattress comprises up to ten independent sections.

3. The sound-controllable multistage massager equipped with LCD device of claim 1, wherein said DC power is supplied by introducing an input from a power converter or an automobile power receptacle to said power supply device.

4. The sound-controllable multistage massager equipped with LCD device of claim 1, wherein said sound-controllable device receives audio frequency signals.

* * * * *